US011668465B2

(12) United States Patent
Nakamura

(10) Patent No.: US 11,668,465 B2
(45) Date of Patent: Jun. 6, 2023

(54) FUEL NOZZLE DEVICE COMPRISING A SWIRLER HAVING SPIRAL SWIRL VANES

(71) Applicant: HONDA MOTOR CO., LTD., Tokyo (JP)

(72) Inventor: Orio Nakamura, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/842,043

(22) Filed: Jun. 16, 2022

(65) Prior Publication Data

US 2023/0003387 A1 Jan. 5, 2023

(30) Foreign Application Priority Data

Jul. 2, 2021 (JP) ..... JP2021-110960

(51) Int. Cl.
*F23R 3/14* (2006.01)
*F23R 3/28* (2006.01)

(52) U.S. Cl.
CPC ..... *F23R 3/14* (2013.01); *F23R 3/286* (2013.01)

(58) Field of Classification Search
CPC ..... F23R 3/14; F23R 3/286
See application file for complete search history.

(56) References Cited

U.S. PATENT DOCUMENTS 3,293,852 A * 12/1966 Galli ..... F02C 6/20 239/265.17
9,557,061 B2 * 1/2017 Biagioli ..... F23R 3/14
2001/0023590 A1 * 9/2001 Mandai ..... F23R 3/14 60/747
2009/0255262 A1 10/2009 McMasters et al.
2010/0175381 A1 * 7/2010 Wilbraham ..... F23C 7/004 431/185
2010/0205971 A1 * 8/2010 Williams ..... F23R 3/28 60/748
2011/0299981 A1 * 12/2011 Li ..... F02M 35/1216 415/206
2020/0318918 A1 * 10/2020 Brooks ..... F28F 25/02
2021/0025594 A1 * 1/2021 Hiromitsu ..... F23R 3/30

FOREIGN PATENT DOCUMENTS

JP 2011528074 A 11/2011

* cited by examiner

*Primary Examiner* — William H Rodriguez
(74) *Attorney, Agent, or Firm* — Armstrong Teasdale LLP

(57) ABSTRACT

A fuel nozzle device for a gas turbine engine includes a nozzle body extending in an axial direction and projecting into the combustion chamber, and swirler including a tubular portion concentrically surrounding the nozzle body, a deflector formed as a hollow shell concentrically surrounding the tubular portion, and a plurality of swirl vanes extending between the tubular portion and the deflector. Each swirl vane extends along a logarithmic spiral around an axial center of the nozzle body between the tubular portion and the deflector with a certain meridian crossing angle α and a certain twist angle Φ such that the outer peripheral inclination angle θ is smaller than the stacking angle β of the swirl vane when the swirl vane is manufactured by an additive manufacturing process with a front end up orientation.

4 Claims, 10 Drawing Sheets

FUEL NOZZLE DEVICE COMPRISING A SWIRLER HAVING SPIRAL SWIRL VANES

TECHNICAL FIELD

The present invention relates to a fuel nozzle device, and more particularly to a gas turbine fuel nozzle device that injects fuel into the combustion chamber of a gas turbine engine.

BACKGROUND ART

In a gas turbine engine, combustion gas that drives the turbine can be obtained by injecting fuel such as kerosine into compressed air and burning the air-fuel mixture formed in the combustion chamber. In order to achieve efficient combustion, it is desired to atomize or vaporize the fuel to cause the fuel and the air to be mixed in favorable manner.

A conventionally known fuel nozzle device includes a nozzle body formed in a substantially tubular shape extending in an axial direction and a swirler positioned around the outer periphery of the nozzle body to define an air passage inclined in the circumferential direction with respect to the axial direction. In such a fuel nozzle device, the fuel ejected into the combustion chamber via the nozzle body and the air introduced into the combustion chamber through the air passage are mixed, and the obtained air-fuel mixture is combusted in the combustion chamber to generate combustion gas. At this time, since the air passage is inclined in the circumferential direction with respect to the axial direction, the air passing through the air passage is formed into a swirl flow centered around the axis so that the fuel and the air can be mixed well. Normally, the steeper the inclination angle of the air passage is with respect to the axial line, the stronger the air passing through the air passage is swirled, and the better the mixing efficiency of the fuel and the air becomes.

However, since such a swirl passage is formed by a plurality of swirl vanes that extend in a spiral shape around the axis, a high cost is required to integrally form such swirl vanes. Further, even if the swirl vanes are each divided into a plurality of segments that are bonded, welded or otherwise joined to one another, the joining of the individual segments require a high cost and special equipment.

As a technology for overcoming this problem, JP2011-528074A discloses a fuel nozzle device fitted with a swirler consisting of a plurality of swirl vanes formed in an airfoil shape by using an additive manufacturing process such as a laser sintering process. According to this prior art, a swirler having a complicated shape can be integrally formed with a relatively low manufacturing cost.

However, the additive manufacturing technology runs into a difficulty when the inclination angle of the spiral swirl vanes with respect to a cross sectional plane is smaller than a prescribed angle, or the stacking angle (relative to the plane orthogonal to the axial direction) is smaller than a prescribed angle (the limit stacking angle $\beta_{min}$). For instance, surface roughness becomes unacceptably great as the stacking angle is reduced. More importantly, when the stacking angle is too small, there is a risk of the vane collapsing during the additive manufacturing process, and a shoring arrangement will become necessary to successfully complete the additive manufacturing process. This further necessitates the removal of the shoring arrangement upon completion of the additive manufacturing process so that the manufacturing cost tends to be undesirably high.

Thus, according to the prior art, there is a limit to the inclination angle of the swirl vanes of the swirler, and the fuel cannot be atomized as finely as desired.

SUMMARY OF THE INVENTION

In view of such a problem of the prior art, a primary object of the present invention is to provide a fuel nozzle device for a gas turbine engine that can be manufactured at low cost by using an additive manufacturing process and can satisfactorily mix fuel and air.

In order to overcome this problem, one aspect of the present invention provides a fuel nozzle device (100) for injecting fuel into a combustion chamber (52) of a gas turbine engine, comprising; a nozzle body (102) extending in an axial direction and projecting into the combustion chamber; and a swirler (103) including a tubular portion (119) concentrically surrounding the nozzle body, a deflector (104) formed as a hollow shell concentrically surrounding the tubular portion, and a plurality of swirl vanes (123) extending between the tubular portion and the deflector, each swirl vane extending along a logarithmic spiral around an axial center of the nozzle body between the tubular portion and the deflector with a certain meridian crossing angle $\alpha$ and a certain twist angle $\Phi$ as measured from a leading edge to a trailing edge of the swirl vane such that an outer peripheral inclination angle $\theta$ as represented by $\theta=\arctan(L/(r\Phi))$ is smaller than a stacking angle of the swirl vane as represented by $\beta=\arctan(L/(r\Phi\cos\alpha))$, where L is the chord length L of the swirl vane as measured in the axial direction, and r is the outer diameter of the tubular portion.

When the swirl vanes are fabricated by an additive fabrication process in a front end up orientation, the stacking angle $\beta$ of the swirl vanes can be thus made greater than the outer peripheral inclination angle $\theta$ of the swirl vanes. Preferably, the outer peripheral inclination angle $\theta$ is smaller than 45 degrees. Thereby, it is possible to reduce the outer peripheral inclination angle $\theta$ while maintaining the stacking angle $\beta$ of the swirl vanes to be equal to or greater than the limit stacking angle $\beta$ by appropriately selecting the meridian crossing angle $\alpha$ and the twist angle $\Phi$. By reducing the outer peripheral inclination angle $\theta$, the air passing through air passages defined between the swirl vanes can be strongly swirled so that the mixing efficiency of the fuel and the air is improved.

Preferably, an annular space is defined between an outer periphery of the nozzle body and the tubular portion, and a plurality of additional swirl vanes (122) extend between the nozzle body and the tubular portion, each additional swirl vane extending along a logarithmic spiral around an axial center of the nozzle body between the nozzle body and the tubular portion with a certain meridian crossing angle $\alpha$ and a certain twist angle $\Phi$ as measured from a leading edge to a trailing edge of the swirl vane such that an outer peripheral inclination angle $\theta$ as represented by $\theta=\arctan(L/(r\Phi))$ is smaller than a stacking angle of the swirl vane as represented by $\beta=\arctan(L/(r\Phi\cos\alpha))$, where L is the chord length L of the swirl vane as measured in the axial direction, and r is the inner diameter of the central cylinder.

By thus providing two sets of swirl vanes in a concentric relationship, a swirl air flow can be generated in an even more favorable manner.

Preferably, the logarithmic spiral of the additional swirl vanes extends circumferentially in an opposite direction to that of the swirl vanes.

Thereby, a swirl air flow can be generated in an even more favorable manner.

Another aspect of the present invention provides a fuel nozzle device (100) for injecting fuel into a combustion chamber (52) of a gas turbine engine, comprising; a nozzle body (102) extending in an axial direction and projecting into the combustion chamber, the nozzle body having an annular configuration so as to include a central cylinder (106) internally defining a central air flow passage; and a swirler (99) including a plurality of swirl vanes (111) extending radially inward from the central cylinder, each swirl vane extending along a logarithmic spiral around an axial center of the nozzle body with a certain meridian crossing angle $\alpha$ and a certain twist angle $\Phi$ as measured from a leading edge to a trailing edge of the swirl vane such that an outer peripheral inclination angle $\theta$ as represented by $\theta=\arctan(L/(r\Phi))$ is smaller than a stacking angle of the swirl vane as represented by $\beta=\arctan(L/(r\Phi\cos\alpha))$, where L is the chord length L of the swirl vane as measured in the axial direction, and r is the inner diameter of the central cylinder.

When the swirl vanes are fabricated by an additive fabrication process in a front end up orientation, the stacking angle $\beta$ of the swirl vanes can be thus made greater than the outer peripheral inclination angle $\theta$ of the swirl vanes. Preferably, the outer peripheral inclination angle $\theta$ is smaller than 45 degrees. Thereby, it is possible to reduce the outer peripheral inclination angle $\theta$ while maintaining the stacking angle $\beta$ of the swirl vanes to be equal to or greater than the limit stacking angle $\beta$ by appropriately selecting the meridian crossing angle $\alpha$ and the twist angle $\Phi$. By reducing the outer peripheral inclination angle $\theta$, the air passing through air passages between the swirl vanes can be strongly swirled so that the mixing efficiency of the fuel and the air is improved.

The present invention thus provides a fuel nozzle device for a gas turbine engine that can be manufactured at low cost by using an additive manufacturing process and can satisfactorily mix fuel and air.

DETAILED DESCRIPTION OF THE PREFERRED EMBODIMENT(S)

Figure 1:
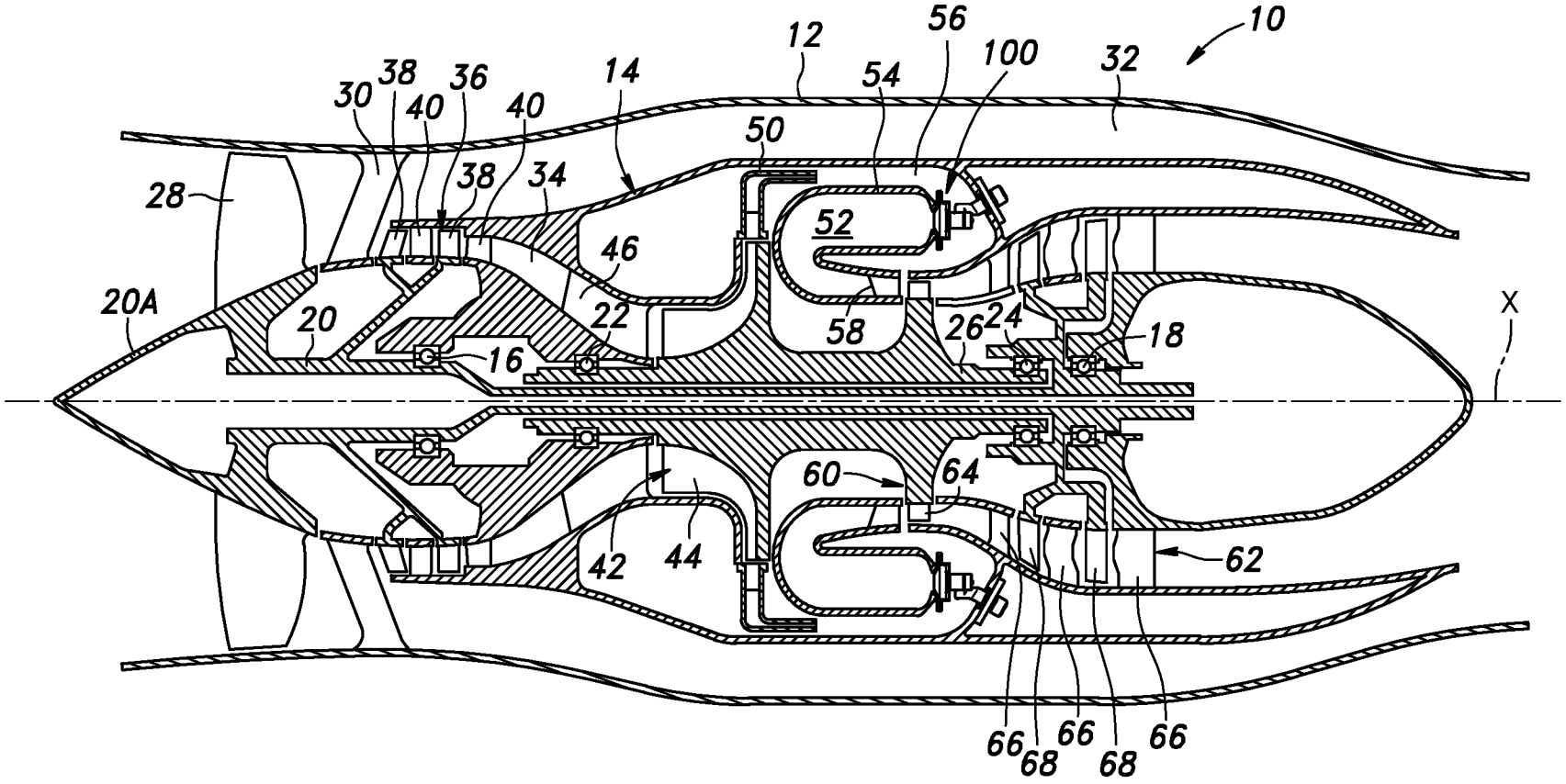
FIG. 1 is a longitudinal sectional view of a gas turbine engine fitted with a fuel nozzle device according to a first embodiment of the present invention.

A fuel nozzle device 100 for a gas turbine engine 10 for aircraft according to a first embodiment of the present invention will be described in the following with reference to FIGS. 1 to 5. First of all, an outline of the gas turbine engine 10 fitted with this fuel nozzle device 100 will be described with reference to FIG. 1.

The gas turbine engine 10 has an outer casing 12 and an inner casing 14 both cylindrical in shape and disposed coaxially to each other about a common central axis X. A low-pressure rotary shaft 20 is rotatably supported by the inner casing 14 via a front first bearing 16 and a rear first bearing 18. A high-pressure rotary shaft 26 consisting of a hollow shaft coaxially surrounds the low-pressure rotary shaft 20 about the common central axis X, and is rotatably supported by the inner casing 14 and the low-pressure rotary shaft 20 via a front second bearing 22 and a rear second bearing 24, respectively.

The low-pressure rotary shaft 20 includes a substantially conical tip portion 20A protruding forward from the inner casing 14. A front fan 28 including a plurality of front fan blades is provided on the outer periphery of the tip portion 20A along the circumferential direction. A plurality of stator vanes 30 are arranged on the outer casing 12 on the downstream side of the front fan 28 at regular intervals along the circumferential direction. Downstream of the stator vanes 30, a bypass duct 32 having an annular cross-sectional shape is defined between the outer casing 12 and the inner casing 14 coaxially with the central axis X. An air compression duct 34 having an annular cross-sectional shape is defined centrally in the inner casing 14.

An axial-flow compressor 36 is provided at the inlet end of the air compression duct 34. The axial-flow compressor 36 includes a pair of rotor blade rows 38 provided on the outer periphery of the low-pressure rotary shaft 20 and a pair of stator vane rows 40 provided on the inner casing 14 in an alternating relationship in the axial direction.

An outlet of the air compression duct 34 is provided with a centrifugal compressor 42 which includes an impeller 44 fitted on the outer periphery of the high-pressure rotary shaft 26. At the outlet end of the air compression duct 34 or the upstream end of the impeller 44, a plurality of struts 46 extend radially in the inner casing 14 across the air compression duct 34. A diffuser 50 is provided at the outlet of the centrifugal compressor 42, and is fixed to the inner casing 14.

The downstream end of the diffuser 50 is provided with a combustor 54 for combusting the fuel therein. The combustor 54 includes an annular combustion chamber 52 centered around the central axis X. The compressed air supplied by the diffuser 50 is forwarded to the combustion chamber 52 via a compressed air chamber 56 defined between the outlet end of the diffuser 50 and the combustion chamber 52.

A plurality of fuel nozzle devices 100 for injecting liquid fuel into the combustion chamber 52 are attached to the inner casing 14 at regular intervals along the circumferential direction around the central axis X. Each fuel injection nozzle device 100 injects liquid fuel into the combustion chamber 52. In the combustion chamber 52, high-temperature combustion gas is generated by combustion of a mixture of the liquid fuel injected from the liquid fuel injection nozzle devices 70 and the compressed air supplied from the compressed air chamber 51.

A high-pressure turbine 60 and a low-pressure turbine 62 are provided on the downstream side of the combustion chamber 52. The high-pressure turbine 60 includes a stator vane row 58 fixed to the outlet end of the combustion chamber 52 which is directed rearward, and a rotor blade row 64 fixed to the outer periphery of the high-pressure rotary shaft 26 on the downstream side of the rotor blade row 64. The low-pressure turbine 62 is located on the downstream side of the high-pressure turbine 60, and includes a plurality of stator vane rows 66 fixed to the inner casing 14 and a plurality of rotor blade rows 68 provided on the outer periphery of the low-pressure rotary shaft 20 so as to alternate with the stator vane rows 66 along the axial direction.

When the gas turbine engine 10 is started, the high-pressure rotary shaft 26 is rotationally driven by a starter motor (not shown). When the high-pressure rotary shaft 26 is rotationally driven, compressed air compressed by the centrifugal compressor 42 is supplied to the combustion chamber 52, and the air-liquid fuel mixture burns in the combustion chamber 52 to generate combustion gas. The combustion gas is impinged upon the blades of the rotor blade rows 64 and 68 to rotate the high-pressure rotary shaft 26 and the low-pressure rotary shaft 20. As a result, the front fan 28 rotates, and the axial-flow compressor 36 and the centrifugal compressor 42 are operated, so that compressed air is supplied to the combustion chamber 52, and the gas turbine engine 10 continues to operate even after the starter motor is disengaged.

Further, a part of the air drawn by the front fan 28 during the operation of the gas turbine engine 10 passes through the bypass duct 32 and is ejected to the rear to generate additional thrust. The rest of the air drawn by the front fan 28 is supplied to the combustion chamber 52, and forms a part of fuel mixture jointly with the liquid fuel. The combustion gas generated by the combustion of the mixture drives the low-pressure rotary shaft 20 and the high-pressure rotary shaft 26, and then is ejected rearward to generate a large part of the thrust provided by this gas turbine engine 10.

The fuel nozzle device 100 will be described in detail in the following with reference to FIG. 2. The fuel nozzle device 100 includes a fuel delivery stem 101 for delivering fuel supplied from a fuel pipe (not shown in the drawings), a nozzle body 102 having an annular configuration for injecting the fuel delivered from the fuel delivery stem 101 toward the combustion chamber 52, an outer swirler 103 that coaxially surrounds a front end part of the nozzle body 102, and an inner swirler 99 provided centrally in the nozzle body 102 in a rear end part of the nozzle body 102. The outer periphery of the outer swirler 103 is coaxially surrounded by a deflector 104 that defines an outer periphery of an air passage of the outer swirler 103 which progressively decreases in diameter toward the front end thereof.

The nozzle body 102 has a central axis A extending parallel to the central axis X. The nozzle body 102 includes a central cylinder 106 having a substantially tubular shape that extends forward from the rear end toward the combustion chamber 52 with the central axis A at the center, a first intermediate cylinder 107 that coaxially surrounds the central cylinder 106, a second intermediate cylinder 108 that coaxially surrounds the first intermediate cylinder 107, and an outer cylinder 109 that coaxially surrounds the second intermediate cylinder 108. The first intermediate cylinder 107 and the second intermediate cylinder 108 are each reduced in diameter toward the front to form a tapered nozzle shape.

Between the central cylinder 106 and the first intermediate cylinder 107 is defined an annular space 105 which is closed at the rear end of the nozzle body 102 and open at the front end of the nozzle body 102. The first intermediate cylinder 107 is generally closely fitted into the second intermediate cylinder 108. Between the second intermediate cylinder 108 and the outer cylinder 109 is defined an annular space 110 which is closed at the rear end of the nozzle body 102 and open at the front end of the nozzle body 102. In the first embodiment, the central cylinder 106, the first intermediate cylinder 107, and the inner swirler 99 are integrally formed as a first single piece member, and the second intermediate cylinder 108 and the outer cylinder 109 are integrally formed as a second single piece member. The first single piece member is generally closely fitted into the second single piece member.

The base end (rear part) of the central cylinder 106 is increased in diameter as compared with the front end par thereof, and in this enlarged diameter portion, a plurality of swirl vanes 111 extend substantially radially inward from the inner peripheral surface of the central cylinder 106 to form an essential part of the inner swirler 99. The swirl vanes 111 jointly define a swirl passage that extend from the base end part to the front end part of the enlarged diameter portion of the central cylinder 106, and the compressed air flowing through the compressed air chamber 56 is introduced into the swirl passage from the open rear end of the central cylinder 106 and forwarded to the combustion chamber 52. Further, the inner peripheral surface of the central cylinder 106 defines a hollow central air flow passage 112 extending along the central axis A. The rear end of this central air flow passage 112 consists of a small diameter section formed centrally of the swirl vanes 111 or the inner swirler 99.

Between the outer peripheral surface of the first intermediate cylinder 107 and the inner peripheral surface of the second intermediate cylinder 108 are defined a first fuel passage 114 communicating with a fuel passage (not shown in the drawings) of the fuel delivery stem 101, a second fuel passages 115 communicating with the downstream end of the first fuel passage 114, a third fuel passage 116 communicating with the downstream end of the second fuel passage 115, and a fourth fuel passage 117 communicating with the downstream end of the third fuel passage 116.

The first fuel passage 114 is provided in the first intermediate cylinder 107 in a rear end part of the nozzle body 102, and includes a circumferential groove formed on the outer peripheral surface of the first intermediate cylinder 107 as an upstream end of the first fuel passage 114. The second fuel passage 115 is formed by a pair of grooves formed on the outer peripheral surface of the first intermediate cylinder 107 at diagonally opposite positions and extending generally in the generatrix direction (axis direction) of the peripheral surface thereof. The second fuel passage 115 communicates with the first fuel passage 114 at the rear end thereof. The third fuel passage 116 is formed by a pair of grooves formed on the outer peripheral surface of the first intermediate cylinder 107, and are skewed so as to form a spiral around the central axis A. The rear end of the third fuel passage 116 communicates with the front end of the second fuel passage 115. The fourth fuel passage 117 is defined between a front end part of the outer peripheral surface of the first intermediate cylinder 107 and a corresponding front end part of the inner peripheral surface of the second intermediate cylinder 108 as an annular gap having the shape of a truncated cone centered around the central axis A.

The outer swirler 103 surrounding the nozzle body 102 will be described in the following in detail with reference to FIGS. 2 to 5. The outer swirler 103 is closely fitted on the outer cylinder 109 of the nozzle body 102 in a coaxial relationship. The outer swirler 103 is provided with a tubular portion 119 having a substantially tubular shape centered around the central axis A, and a tip portion 120 extending forward at the front end of the tubular portion 119 and tapering toward the front end which is provided with a central opening. The tubular portion 119 is positioned between the deflector 104 and the nozzle body 102 in a concentric relationship.

Figure 2:
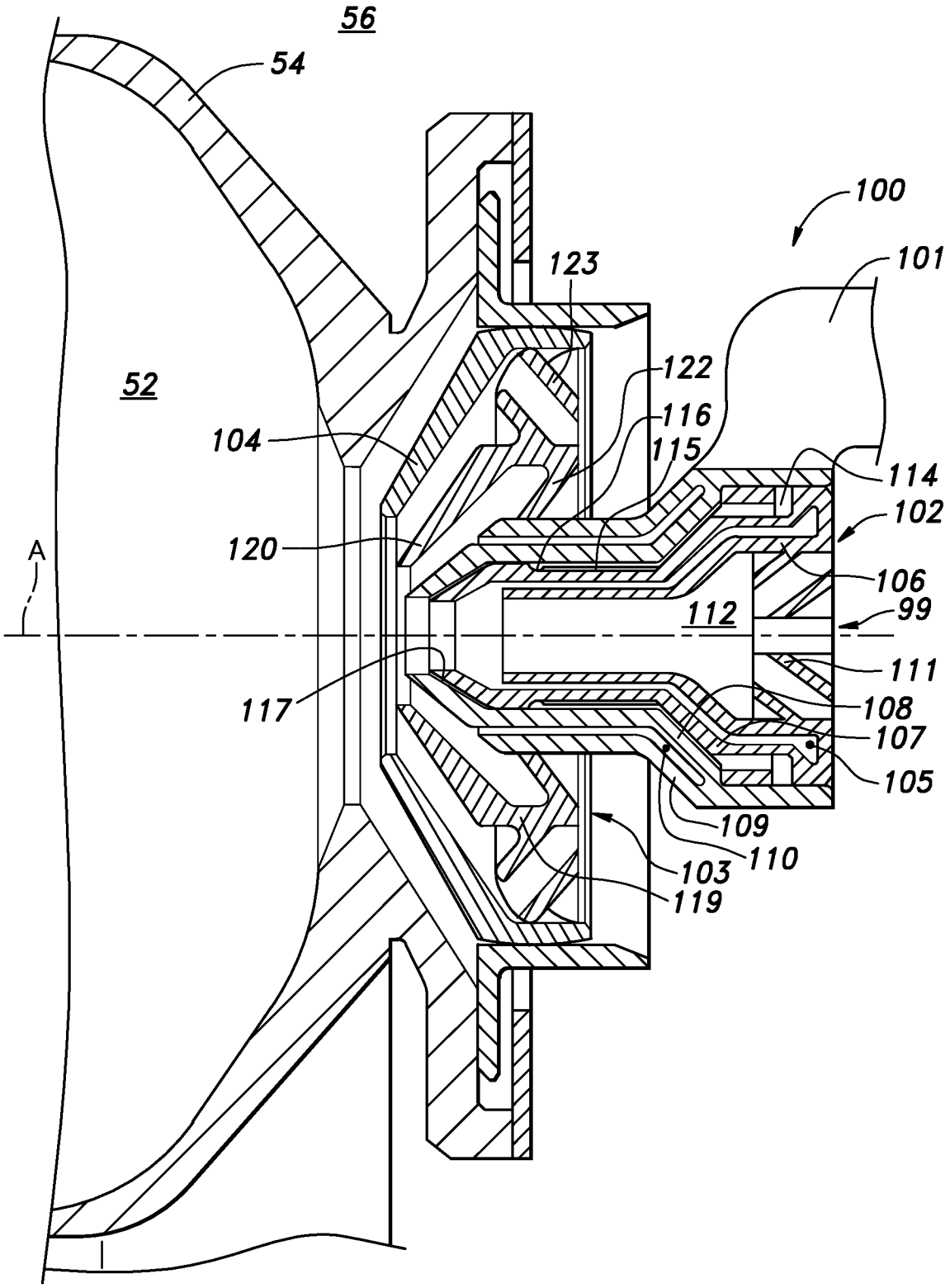
FIG. 2 is a longitudinal sectional view of the fuel nozzle device.

A plurality of inner swirl vanes 122 extend inward in the substantially radial direction from the inner peripheral surface of the tubular portion 119 (see FIG. 2). Further, a plurality of outer swirl vanes 123 extend outward in the substantially radial direction from the outer peripheral surface of the tubular portion 119. The tubular portion 119 has an outer peripheral radius r (see FIG. 3). The radially inner ends of the inner swirl vanes 122 abut against or fit onto the outer periphery of the outer cylinder 109.

The inner swirl vanes 122 are arranged on the inner peripheral surface of the tubular portion 119 at predetermined intervals along the circumferential direction. The tip edge of each inner swirl vane 122 is in contact with the outer peripheral surface of the outer cylinder 109. The outer swirler 103 (inner swirl vanes 122) may be connected to the outer peripheral surface of the outer cylinder 109 by brazing or welding the tip edges of the inner swirl vanes 122 to the outer peripheral surface of the outer cylinder 109.

The outer swirl vanes 123 are arranged on the outer peripheral surface of the tubular portion 119 at predetermined intervals along the circumferential direction. Since the outer swirl vanes 123 are all substantially identical in shape to each other, only one of the outer swirl vanes 123 is shown in the swirler 103 illustrated in FIGS. 3 to 5 for the purpose of improved clarity. The outer swirl vane 123 has a front end surface 125 extending from the outer peripheral surface of the tubular portion 119 substantially radially outward and orthogonally to the axis A, a rear end surface 126 extending from the trailing edge of the outer peripheral surface of the tubular portion 119 substantially radially outward and orthogonally to the axis A, and an inclined curved surface 127 connecting the outer edges of the front end surface 125 and the rear end surface 126 (see FIG. 3) to each other. The outer swirl vane 123 has a chord length L as measured in the axial direction (see FIG. 5), i. e. the distance L (chord length) between the front end surface 125 and the rear end surface 126 as measured in the axial direction. The chord length L is constant over the entire circumferential length of each outer swirl vane 123 in this embodiment.

The inclined curved surface 127 of the outer swirl vane 123 is a curved surface forming a part of a cylindrical surface, and the tip edge of the inclined curved surface 127 abuts on the inner peripheral surface of the deflector 104 (see FIG. 2). The outer swirler 103 and the deflector 104 are jointed to each other by connecting the tip edge of the outer swirl vane 123 to the inner peripheral surface of the deflector 104 by brazing or any other method.

The front end surface 125 of the outer swirl vane 123 extends along a first logarithmic spiral 129 (see FIG. 4) centered on the central axis A on a cross sectional plane S1 (see FIG. 5) orthogonal to the central axis A and passing through the front end surface 125 of the outer swirl vane 123. Further, the rear end surface 126 of the outer swirl vane 123 extends along a second logarithmic spiral 130 (see FIG. 4) centered on the central axis A on a cross sectional plane S2 (see FIG. 5) orthogonal to the central axis A and passing through the rear end surface 126 of the outer swirl vane 123 and obtained by twisting the first logarithmic spiral 129 by a twist angle Φ [deg] around the central axis A. In other words, the outer swirl vane 123 is twisted from the leading edge to the trailing edge b by the twist angle Φ around the central axis A. Each cross section of the outer swirl vane 123 extends along a logarithmic spiral centered on the central axis A.

Figure 3:
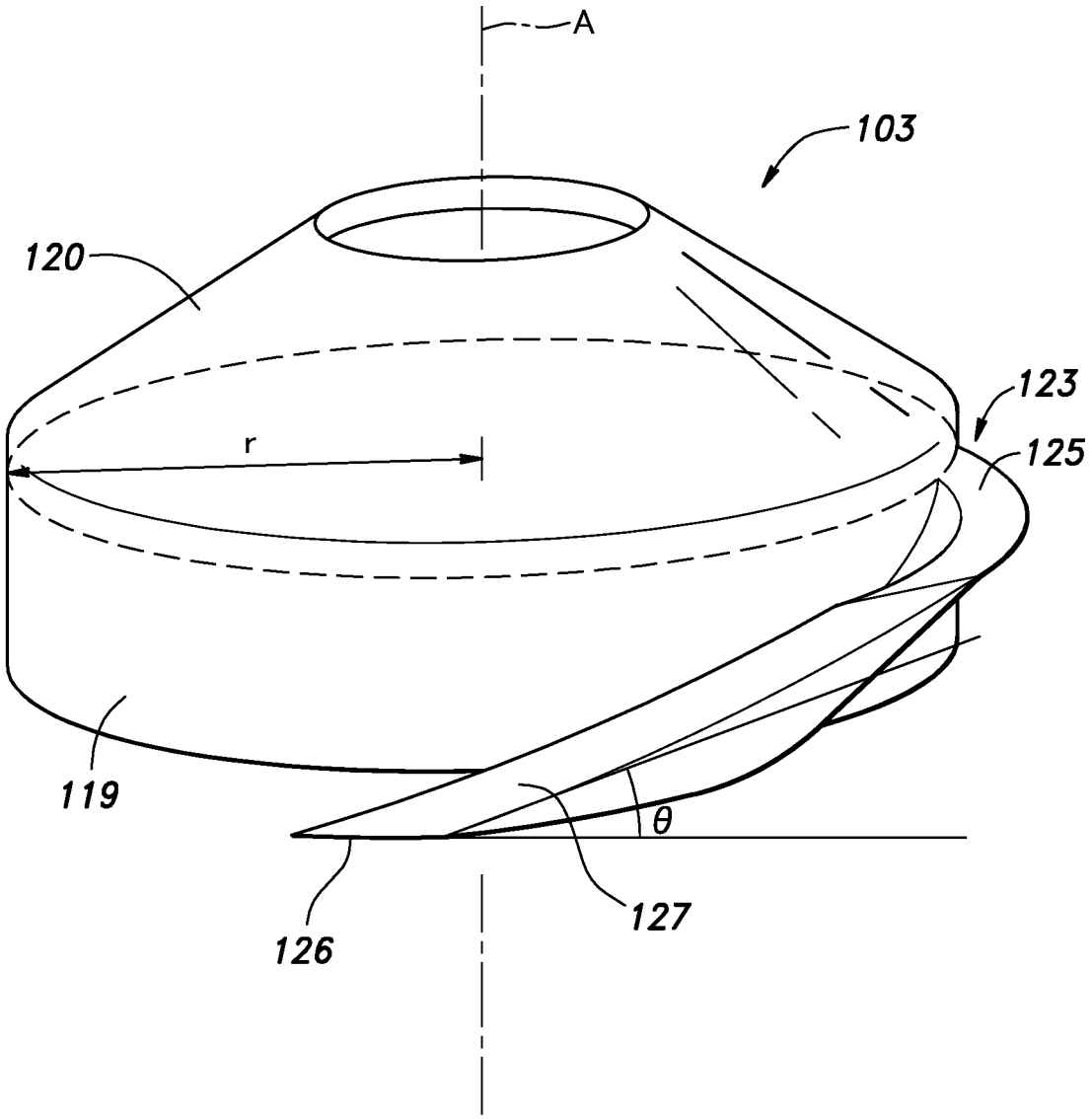
FIG. 3 is a schematic perspective view of a swirler of the fuel nozzle device.
Figure 5:
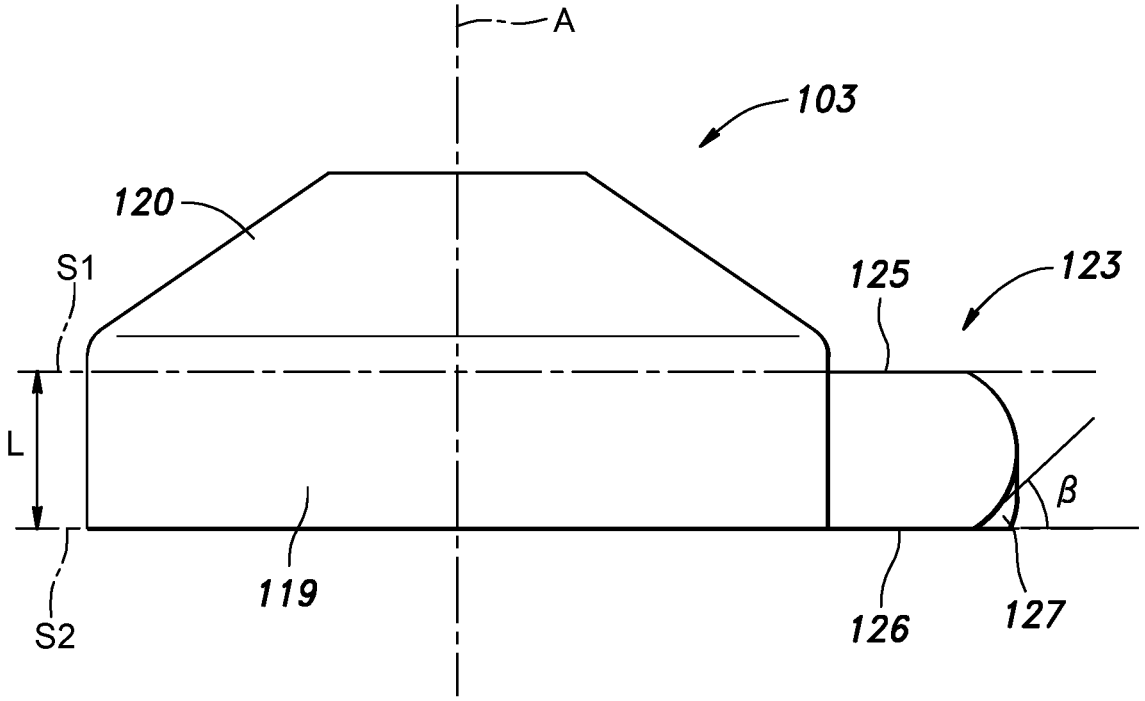
FIG. 5 is a schematic side of the swirler.

As shown in FIG. 3, the outer edge of the inclined curved surface 127 of the outer swirl vane 123 is inclined by an outer peripheral inclination angle θ [deg] with respect to the cross sectional plane S2 orthogonal to the central axis (see FIG. 5). The thickness of the outer swirl vane 123 of this embodiment is substantially constant over the entire axial length. The outer peripheral inclination angle θ is related to the chord length L in the axial direction of the outer swirl vane 123, the outer peripheral radius r of the tubular portion 119, and the twist angle Φ as represented by $\theta=\arctan(L/(r\Phi))$. The outer peripheral inclination angle θ in the first embodiment is less than 45 degrees. As the outer peripheral inclination angle θ approaches 0 degrees, the inclination angle of the air passage defined between the outer swirl vanes 123 approaches 90 degrees so that the twisting force of the compressed air passing through the air passage increases.

Figure 4:
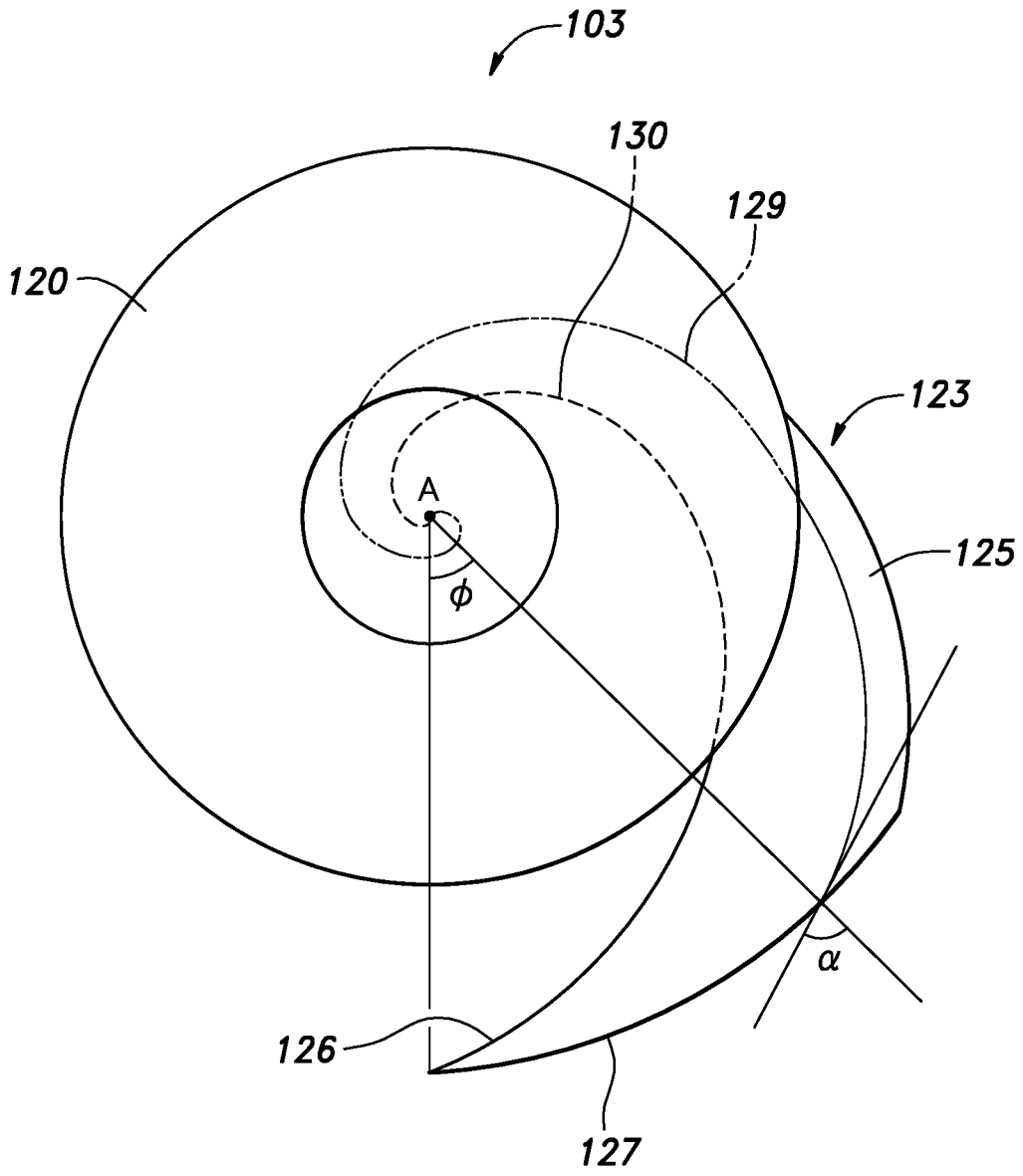
FIG. 4 is a schematic front view of the swirler.

As shown in FIG. 4, the shapes of the first logarithmic spiral 129 and the second logarithmic spiral 130 are defined by a meridian crossing angle α [deg] which is defined by a line extending from the central axis A to an arbitrary point on the first logarithmic spiral 129 (second logarithmic spiral 130) on the cross sectional plane S1 and a tangent line of the first logarithmic spiral 129 (second logarithmic spiral 130) at this point. Therefore, the meridian crossing angle α is equal to the complementary angle of the pitch angle of the first logarithmic spiral 129 (the second logarithmic spiral 130). As the meridian crossing angle α comes closer to zero, the distance of the first logarithmic spiral 129 and the second logarithmic spiral 130 to the central axis A approaches at a faster rate. Conversely, as the meridian crossing angle α comes closer to 90 degrees, the distance of the first logarithmic spiral 129 and the second logarithmic spiral 130 to the central axis A approaches at a slower rate.

As shown in FIG. 5, the outer swirl vane 123 is inclined with respect to the cross sectional plane S2 by a stacking angle β [deg] which is related to the chord length L of the outer swirl vane 123 in the axial direction, the outer peripheral radius r of the tubular portion 119, the twist angle Φ, and the meridian crossing angle α as represented by $\beta=\arctan(L/(r\Phi\cos\alpha))$. The stacking angle β is an angle by which the swirler 103 is laminated or stacked up from the rear end to the front end by using an additive manufacturing process. The closer the stacking angle β is to 0 degrees, the more difficult it becomes to manufacture the outer swirl vane 123 by using the additive manufacturing process. In particular, when the stacking angle β is less than a certain limit stacking angle $\beta_{min}$, a support portion for shoring or supporting the laminated part is required in order to manufacture the outer swirl vane 123 having a high molding accuracy by using the additive manufacturing process. The stacking angle β in the first embodiment may be 45 degrees or more (the limit stacking angle $\beta_{min}$=45 degrees).

Thus, by setting the stacking angle β of the outer swirl vane 123 to the limit stacking angle $\beta_{min}$ or greater, additive manufacturing can be performed to manufacture the outer swirl vane 123 without requiring a support portion for supporting the outer swirl vane 123. The same is true with the inner swirl vanes 122 (and the swirl vanes 111 of the inner swirler 99). In the case of the inner swirl vanes 122 (and the swirl vanes 111 of the inner swirler 99), r in the equation $\beta=\arctan(L/(r\Phi\cos\alpha))$ is the inner diameter of the tubular portion 119. By this providing both the twist angle Φ, and the meridian crossing angle α to the swirl vanes, the effective swirl angle of the swirl vanes can be increased to be substantially greater than the stacking angle. As a result, the cost required for preparing and removing the support portion and the like can be eliminated so that the manufacturing cost of the fuel nozzle device 100 can be minimized.

The mode of operation of the fuel nozzle device 100 will be described in the following with reference to FIG. 2. The fuel supplied from a fuel pipe (not shown in the drawing) is introduced into the first fuel passage 114 via a fuel delivery passage (not shown in the drawing) defined in the fuel delivery stem 101. The fuel then passes through the second fuel passage 115 and the third fuel passage 116, and is introduced into the fourth fuel passage 117. In this conjunction, since the third fuel passage 116 is inclined in the circumferential direction with respect to the central axis A, the fuel introduced into the fourth fuel passage 117 turns into a swirling flow centered around the central axis A. The fuel then passes through the fourth fuel passage 117 and is ejected into the combustion chamber 52.

A part of the compressed air flowing in the compressed air chamber 56 is introduced into the central air flow passage 112 via the swirl vanes 111 of the inner swirler 99 provided at the base end of the central cylinder 106. At this time, since the swirl vanes 111 are inclined in the circumferential direction with respect to the axial direction, the compressed air introduced into the central air flow passage 112 turns into a swirling flow centered around the central axis A. This swirling flow is ejected from the opening at the front end of the central cylinder 106 into the combustion chamber 52, and is favorably mixed with the fuel ejected from the fourth fuel passage 117.

A part of the compressed air in the compressed air chamber 56 is introduced into the combustion chamber 52 via the inner swirl vanes 122 of the outer swirler 103 and an annular ejecting port defined between the tip of the outer cylinder 109 and the tip portion 120 of the tubular portion 119 of the outer swirler 103 on the downstream side of the inner swirl vanes 122. Further, another part of the compressed air in the compressed air chamber 56 is introduced into the combustion chamber 52 via the outer swirl vanes 123 of the outer swirler 103 and an annular ejecting port defined between the tip portion 120 of the tubular portion 119 of the outer swirler 103 and the tip of the deflector 104. Since the inner swirl vanes 122 and the outer swirl vanes 123 are inclined in the circumferential direction with respect to the axial direction (in mutually opposite directions in this embodiment), the compressed air passing through the inner swirl vanes 122 and the outer swirl vanes 123 is swirled around the central axis A. These swirling flows cause the air-fuel mixture ejected from the opening on the front end of the second intermediate cylinder 108 to be in a favorably mixed state. As a result, highly atomized fuel is ejected into the combustion chamber 52.

Here, as described with reference to FIGS. 3 and 4, the inner swirl vanes 122 and the outer swirl vanes 123 each have a twisted shape with a certain meridian crossing angle $\alpha$ and a certain outer peripheral inclination angle $\theta$. As a result, even though the stacking angle $\beta$ is limited to be equal to or greater than the limit stacking angle $\beta_{min}$, the outer peripheral inclination angle $\theta$ can be set to be smaller than the limit stacking angle $\beta_{min}$. In other words, the inclination angles of the air passage defined by the swirl vanes 111, the air passage defined by the inner swirl vanes 122, and the air passage defined by the outer swirl vanes 123 are not limited to the limit stacking angle $\beta_{min}$, but can be smaller than the limit stacking angle $\beta_{min}$. By thus allowing the outer peripheral inclination angle $\theta$ to be smaller than the stacking angle $\beta$, the air passing through the air passages is swirled particularly strongly so that the mixing efficiency of the fuel and the air is improved.

FIGS. 6 to 9 show a fuel nozzle device 100 fitted with an inner swirler 200 according to a second embodiment of the present invention. Since the fuel nozzle device 100 of the second embodiment differs from that of the first embodiment only in the configuration of the inner swirler 200, the description of the remaining part of the fuel nozzle device 100 is omitted from the following disclosure.

The inner swirler 200 is provided with an outer shell 201 coaxially surrounded by the central cylinder 106.

Figure 8:
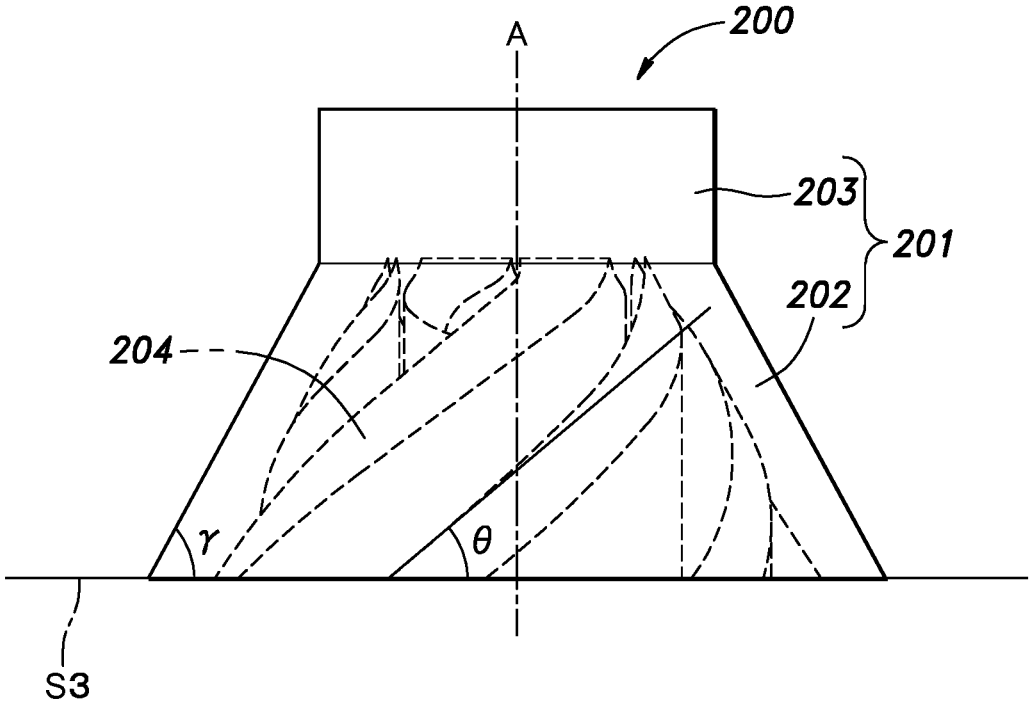
FIG. 8 is a see-through side view of the swirler.

As shown in FIG. 8, the outer shell 201 includes a conical section 202 having a progressively decreasing diameter toward the front end thereof, a small-diameter cylindrical section 203 extending forward from the front end of the conical section 202, and a large-diameter cylindrical section (not shown in the drawings) extending rearward from the rear end of the conical section 202. (The rear end of the conical section 202 is denoted with a cross sectional plane S3 in FIG. 8.) The outer shell 201 is conformally fitted in and in contact with the inner periphery of the base end of the central cylinder 106. Further, the outer shell 201 is coaxially disposed with respect to the central axis A. In an alternate embodiment, the central cylinder 106 and the outer shell 201 are integrally formed as a single-piece member.

Figure 6:
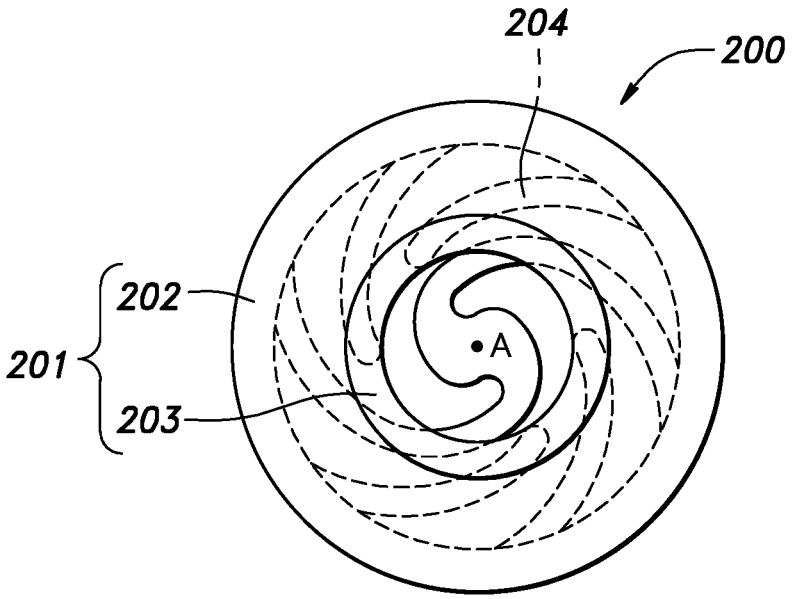
FIG. 6 is a front view of a swirler according to a second embodiment of the present invention.
Figure 7:
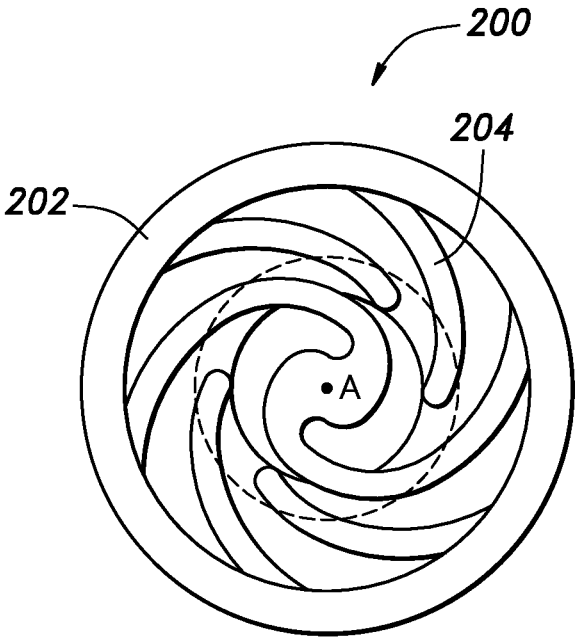
FIG. 7 is a rear view of the swirler.

As shown in FIGS. 6 and 7, a plurality of swirl vanes 204 extend radially inward from the inner peripheral surface of the conical section 202. The swirl vanes 204 are arranged at predetermined intervals in the circumferential direction and extend axially substantially over the axial length of the conical section 202. Each swirl vane 204 extends along a predetermined logarithmic spiral centered on the central axis A at each cross section thereof. The meridian cross angle $\alpha$ of this logarithmic spiral is greater than 0, and is smaller than 90 degrees.

Figure 9:
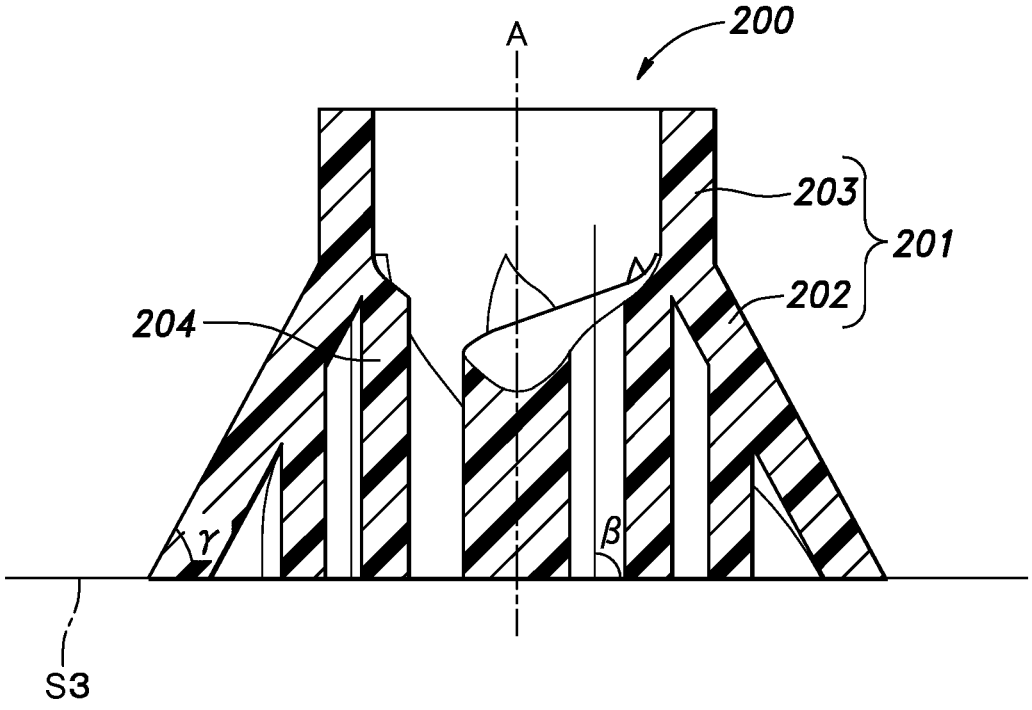
FIG. 9 is a longitudinal sectional view of the swirler in a front end up orientation.

As shown in FIG. 8, the outer peripheral surface of the swirl vane 204 is inclined by an outer peripheral inclination angle $\theta$ [deg] with respect to the cross sectional plane S3. In the second embodiment, the outer peripheral inclination angle $\theta$ is smaller than 45 degrees. As shown in FIG. 9, when the inner swirler 200 is fabricated by an additive fabrication process in a front end up orientation, the stacking angle $\beta$ of the swirl vanes 204 is 90 degrees. The stacking angle $\gamma$ of the conical section 202 of the outer shell 201 is somewhat greater than 45 degrees.

As a result, even though the stacking angle $\beta$ of the swirl vanes 204 and the stacking angle $\gamma$ of the conical section 202 are equal to or larger than the limit stacking angle $\beta_{min}$, the outer peripheral inclination angle $\theta$ can be made smaller than the limit stacking angle $\beta_{min}$, or in other words, the inclination angle of the air passages defined between the swirl vanes 204 can be made smaller than the limit stacking angle $\beta_{min}$. In this way, the outer peripheral inclination angle $\theta$ can be made smaller than the stacking angle $\beta$ of the swirl vanes 204 and the stacking angle $\gamma$ of the conical section 202, so that the air passing through the air passages is swirled strongly, and the mixing efficiency of the fuel and air can be improved.

The present invention has been described in terms of specific embodiments, but is not limited by such embodiments, and can be modified in various ways without departing from the spirit of the present invention. For example, the first embodiment is provided with the outer swirler 103 and the inner swirler 99, but may be provided with only one of them. Further, the outer swirler 103 may be provided only with the inner swirl vanes 122 or the outer swirl vanes 123. Also, the present invention may be applied to only one of the outer swirler 103 and the inner swirler 99 while the other is conventional in structure.

Figure 10:
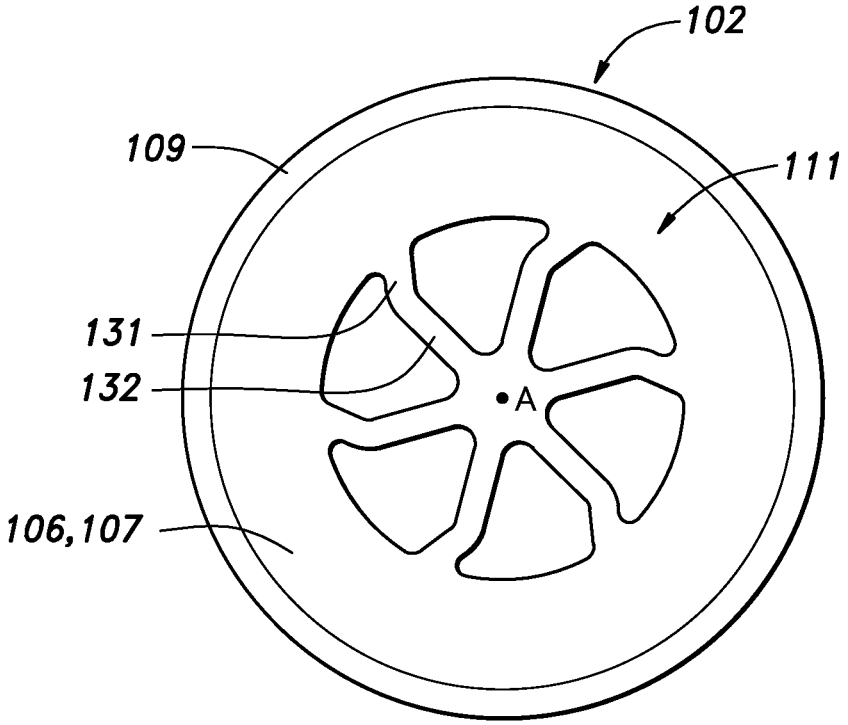
FIG. 10 is rear view of a swirler according to a modified embodiment of the present invention.

Further, only a part of each swirl vane may be constructed according to the present invention while the remaining part of the swirl vane is conventional in configuration. In the modified embodiment shown in FIG. 10, each swirl vane 111 includes a first section 131 extending radially inward from the outer shell with a certain meridian crossing angle in similar fashion as the swirl vane 204 of the second embodiment, and a second section 132 extending radially inward from the first section 131 with substantially zero meridian crossing angle.

The invention claimed is:

1. A fuel nozzle device for injecting fuel into a combustion chamber of a gas turbine engine, comprising;

a nozzle body extending in an axial direction and projecting into the combustion chamber; and a swirler including a tubular portion concentrically surrounding the nozzle body, a deflector formed as a hollow shell concentrically surrounding the tubular portion, and a plurality of swirl vanes extending between the tubular portion and the deflector, each swirl vane extending along a logarithmic spiral around an axial center of the nozzle body between the tubular portion and the deflector with a certain meridian crossing angle $\alpha$ and a certain twist angle $\Phi$ as measured from a leading edge to a trailing edge of the swirl vane such that an outer peripheral inclination angle $\theta$ as represented by $\theta=\arctan(L/(r\Phi))$ is smaller than a stacking angle of the swirl vane as represented by $\beta=\arctan(L/(r\Phi\cos\alpha))$, where L is the chord length L of the swirl vane as measured in the axial direction, and r is the inner diameter of the central cylinder.

2. The fuel nozzle device according to claim 1, wherein an annular space is defined between an outer periphery of the nozzle body and the tubular portion, and a plurality of additional swirl vanes extend between the nozzle body and the tubular portion, each additional swirl vane extending along a logarithmic spiral around an axial center of the nozzle body between the nozzle body and the tubular portion with a certain meridian crossing angle $\alpha$ and a certain twist angle $\Phi$ as measured from a leading edge to a trailing edge of the swirl vane such that an outer peripheral inclination angle $\theta$ as represented by $\theta=\arctan(L/(r\Phi))$ is smaller than a stacking angle of the swirl vane as represented by $\beta=\arctan(L/(r\Phi\cos\alpha))$, where L is the chord length L of the swirl vane as measured in the axial direction, and r is the inner diameter of the central cylinder.

3. The fuel nozzle device according to claim 2, wherein the logarithmic spiral of the additional swirl vanes extends circumferentially in an opposite direction to that of the swirl vanes.

4. A fuel nozzle device for injecting fuel into a combustion chamber of a gas turbine engine, comprising;

a nozzle body extending in an axial direction and projecting into the combustion chamber, the nozzle body having an annular configuration so as to include a central cylinder internally defining a central air flow passage; and a swirler including a plurality of swirl vanes extending radially inward from the central cylinder, each swirl vane extending along a logarithmic spiral around an axial center of the nozzle body with a certain meridian crossing angle $\alpha$ and a certain twist angle $\Phi$ as measured from a leading edge to a trailing edge of the swirl vane such that an outer peripheral inclination angle $\theta$ as represented by $\theta=\arctan(L/(r\Phi))$ is smaller than a stacking angle of the swirl vane as represented by $\beta=\arctan(L/(r\Phi\cos\alpha))$, where L is the chord length L of the swirl vane as measured in the axial direction, and r is the inner diameter of the central cylinder.

* * * * *